US011804345B2

(12) United States Patent
Arrighetti et al.

(10) Patent No.: US 11,804,345 B2
(45) Date of Patent: Oct. 31, 2023

(54) LOW-VOLTAGE CIRCUIT BREAKER

(71) Applicant: ABB S.p.A., Milan (IT)

(72) Inventors: Pierantonio Arrighetti, Bossico (IT); Marco Bonfanti, Presezzo (IT)

(73) Assignee: ABB S.p.A., Milan (IT)

( * ) Notice: Subject to any disclaimer, the term of this patent is extended or adjusted under 35 U.S.C. 154(b) by 0 days.

(21) Appl. No.: 17/049,071

(22) PCT Filed: Apr. 19, 2019

(86) PCT No.: PCT/EP2019/060239
§ 371 (c)(1),
(2) Date: Oct. 20, 2020

(87) PCT Pub. No.: WO2019/202152
PCT Pub. Date: Oct. 24, 2019

(65) Prior Publication Data

US 2021/0249208 A1 Aug. 12, 2021

(30) Foreign Application Priority Data

Apr. 20, 2018 (EP) ..... 18168532

(51) Int. Cl.
*H01H 33/08* (2006.01)
*H01H 33/42* (2006.01)
(Continued)

(52) U.S. Cl.
CPC ..... *H01H 33/42* (2013.01); *H01H 33/08* (2013.01); *H01H 33/53* (2013.01); *H01H 71/10* (2013.01)

(58) Field of Classification Search
CPC ..... H01H 33/08; H01H 33/42; H01H 33/53; H01H 71/10; H01H 71/128;
(Continued)

(56) References Cited

U.S. PATENT DOCUMENTS 3,631,369 A * 12/1971 Menocal ..... B60S 3/04 337/110
5,103,198 A 4/1992 Morel et al.
(Continued)

FOREIGN PATENT DOCUMENTS

DE 102009015222 A1 10/2010
EP 0455564 A1 11/1991

OTHER PUBLICATIONS

Translation DE102009015222 (original document published Oct. 7, 2010) (Year: 2010).*

(Continued)

*Primary Examiner* — William A Bolton
(74) *Attorney, Agent, or Firm* — Armstrong Teasdale LLP

(57) ABSTRACT

A low-voltage circuit breaker includes at least one fixed contact, for each pole, which is electrically connected to a terminal for connection to an electric circuit, and a corresponding moving contact which is associable/separable with respect to the fixed contact by a rotation of the moving contact. The low-voltage circuit breaker further includes an arc chamber positioned in correspondence of the fixed contact, and a rotating contact supporting shaft common to all poles, which is functionally connected to an actuation mechanism of the circuit breaker, where the actuation mechanism includes a kinematic system operatively connected to an actuation lever for opening/closing operations and provided with opening springs and a tripping shaft for releasing the kinematic system and allowing its movement from a closed to an open position. The low-voltage circuit breaker further includes, for each pole, a quick acting trip device.

15 Claims, 5 Drawing Sheets

(51) Int. Cl.
*H01H 33/53* (2006.01)
*H01H 71/10* (2006.01)

(58) Field of Classification Search
CPC ..... H01H 71/2418; H01H 2071/025; H01H 75/00; H01H 77/02; H01H 71/04; H01H 71/40; H01H 75/12; H01H 71/24; H01H 71/12; H01H 1/20; H01H 2071/2427; H01H 1/2058
USPC ..... 218/146, 148, 149, 155, 156, 157, 114; 200/243, 306, 508; 335/6, 201, 202, 174
See application file for complete search history.

(56) References Cited

U.S. PATENT DOCUMENTS 6,281,458 B1 * 8/2001 Castonguay ..... H01H 1/2058 218/22
7,403,087 B2 * 7/2008 Oh ..... H01H 77/10 335/172
8,063,334 B2 * 11/2011 Dahl ..... H01H 9/342 218/114
8,471,657 B1 * 6/2013 Shea ..... H01H 71/12 335/201
2001/0045879 A1 * 11/2001 Reichard ..... H01H 77/02 335/172
2004/0239458 A1 12/2004 Harmon et al.
2005/0151607 A1 7/2005 Li et al.
2012/0026638 A1 2/2012 Ahlert
2012/0168292 A1 7/2012 Woodson et al.
2015/0136740 A1 * 5/2015 Afshari ..... H01H 33/08 218/149

OTHER PUBLICATIONS

European Patent Office, International Search Report & Written Opinion issued in corresponding Application No. PCT/EP2019/060239, dated May 31, 2019, 17 pp.
European Patent Office, Extended Search Report issued in corresponding Application No. 18168532.2, dated Oct. 19, 2018, 9 pp.

* cited by examiner

LOW-VOLTAGE CIRCUIT BREAKER

The present invention relates to a low-voltage circuit breaker, i.e., for applications with operating voltages up to 2000 volts.

It is known that low-voltage industrial electrical systems, characterized by operating voltages up to 2000 volts and by electric currents of relatively high nominal value which produce correspondingly high power levels, normally use specific protection devices, commonly known in the art as automatic power circuit breakers.

Said power circuit breakers comprise one or more electric poles, whose number determines their designation in practice as single-pole, two-pole, three-pole circuit breakers and so forth. In turn, each electric pole comprises at least two contacts, a fixed contact and a moving contact, which can be mutually coupled/uncoupled and are electrically connected to the phase or neutral conductor associated with said electric pole. Generally, the moving contacts of each pole of the circuit breaker are mounted on a rotating contact supporting shaft that is connected mechanically to the actuation mechanism of said circuit breaker, for example a spring-type kinematic system, and allows to transmit the motion among the various poles.

These circuit breakers are designed so as to provide a number of features required to ensure the correct operation of the electrical system in which they are inserted and of the loads connected to it. For example, they ensure the nominal current required for the various users, allow correct insertion and disconnection of the loads with respect to the circuit, protect the loads against abnormal events such as overloading and short-circuits by opening the circuit automatically, and allow to disconnect the protected circuit by galvanic separation or by opening suitable contacts in order to achieve full isolation of the load with respect to the electric power source.

Currently, a number of low-voltage power circuit breakers are available according to various industrial embodiments in which the opening of the contacts is generally carried out by more or less complicated kinematic mechanisms. Such kinematic actuation mechanisms normally utilize the mechanical energy stored beforehand in special opening springs and are generally triggered, in case of electrical fault, by an appropriate protection device, typically a relay.

In practice, a pole of a low-voltage power circuit breaker generally comprises at least one fixed contact which is connected electrically, by means of an appropriately configured conductor, to a terminal for connection to an electric circuit, according to embodiments that are widely known in the art. The pole furthermore comprises a moving contact and a corresponding supporting shaft which is functionally connected to the moving contact and to a circuit breaker actuation mechanism. Said actuation mechanism generally comprises a kinematic system with opening springs and allows to connect functionally the moving contact supporting shaft to a lever for the manual actuation of the circuit breaker. The circuit breaker, moreover, is usually provided with a protection device for protection against electrical faults, typically a relay, which trips when an electrical fault occurs, causing the actuation of the actuation mechanism, with consequent rotation of the contact supporting shaft and release of the circuit breaker.

In certain operating conditions, particularly when the presumed short-circuit current can assume significantly high values, the use of devices that utilize in a traditional manner the energy that can be accumulated in the opening springs for opening the contacts could be not very efficient and economical. In such cases, a typical solution is to resort to special types of automatic circuit breaker that have technical solutions aimed at increasing their breaking capacity.

Among the technical solutions that are currently most widely used, a typical solution forces the current to follow a given path, so that when a short circuit occurs, electrodynamic repulsion forces occur between the fixed and movable contacts. These repulsion forces generate a useful thrust that helps to increase the separation speed of the moving contacts with respect to the fixed contacts. In this manner, the intervention time is reduced and the presumed short-circuit current is prevented from reaching its maximum value.

It is also known to have in each pole of a low-voltage power circuit breakers at least one arc chamber, i.e., a region of space particularly designed to foster electric-arc interruption. Arc chambers can be simple regions provided in the casing of the switch, or else can comprise various modular elements shaped, for example, like casings made of insulating material equipped with arc-breaking plates.

As a consequence of the opening movement, the voltage between the contacts causes the dielectric discharge of the air, leading to the formation of the electric arc in the chamber. The arc is propelled by electromagnetic and fluid-dynamics effects inside a series of arc-breaking metal plates arranged in the chamber, which are meant to extinguish said arc by cooling and splitting actions.

During arc forming, the energy released by Joule effect is very high and brings about a hot gas release and an increase of pressure inside the chamber. Although the hot gases are generally vented outside the chamber thorough one or more specifically designed venting channels, the energy released causes high thermal and mechanical stresses inside the circuit breaker. Therefore, it would be desirable to reduce the intervention time and carry out the opening operation as quick as possible in order to reduce the arching phenomena.

In this regard, it is known to provide the low-voltage power circuit breakers with quick acting trip devices so as to reduce the intervention times in case of a short circuit.

For instance, it is known to use trip devices which are based on magnetic principles to detect a surge of the current above a certain threshold and then determining a quick release of the contacts and the opening of the circuit breaker. Intervention is therefore not directly connected to the development of an electrical arc, but to the raise of the current above a certain level.

From EP0455564 it is also known to use an overpressure actuator which—when an overpressure occurs in the arc chamber as a consequence of an arc—brings about actuation by a piston, subjected to this overpressure, of the circuit breaker tripping shaft. The intervention threshold is determined by the force of a spring which keeps the piston in a non-operating position during normal operations and which is compressed when the pressure rises above a certain level, thereby allowing the piston to act on the circuit breaker tripping shaft. The piston of the actuating device is common to all phases of the circuit breaker and acts directly onto the circuit breaker tripping shaft.

At the current state of the art, the existing solution for quick opening power circuit breaker, have a number of disadvantages that it would be desirable to overcome.

In particular, in case of circuit breakers where the quick tripping mechanism is based on a magnetic circuit concatenated with the electrical circuit, a first drawback is given by the fact that intervention could take place also in the absence of arching phenomena. In other words, the action of the quick tripping mechanism is not determined directly by the formation of an electrical arc but by a secondary evidence given by the current surge, thereby bringing about undesired tripping actions in the absence of an arc. Moreover, since it is based on a non-linear phenomenon, proper dimensioning and calibration of the quick tripping mechanism are very difficult and complicated, especially with reference to unwanted frictions, stuckings, tolerance matching.

As for the system disclosed in EP0455564, a first drawback is given by the fact that the overpressure possibly generated in the arc chambers of the various poles as a consequence of an electrical arc does not operate onto the actuating piston directly, but through an exhaust manifold which put the various arc chambers into communication with a single actuating piston, thereby complicating the design of the circuit breaker and making the system less reliable and less prompt to act.

A further problem of the system of EP0455564 is given by the fact the intervention threshold of the quick tripping device can be determined only through proper dimensioning of the force of the spring against which the piston acts, thereby making calibration very difficult. Moreover, the spring characteristics may change over the time due e.g., to aging phenomena or due to other factors such as a more or less abrupt change of temperature, thereby making the system less reliable.

Still another problem of the device of EP0455564 is given by the fact the spring, used in the device to set the intervention threshold and bring the piston back to the original position, may be a delicate component of the system, prone to ruptures and malfunctioning that may have an adverse impact on the functionality and reliability of the device.

Furthermore, in general, the low-voltage power circuit breakers with quick acting trip devices of known type are formed by a relatively high number of parts which are relatively complicated to be produced, make difficult their assembly, and increase their manufacturing costs.

Hence, the present disclosure is aimed at providing a low-voltage power circuit breaker provided with a quick acting trip device, which allows overcoming at least some of the above-mentioned shortcomings.

In particular, the present invention is aimed at providing a low-voltage power circuit breaker provided with a quick acting trip device, in which the tripping action is determined directly by the formation of an electrical arc in one of the arc chambers.

Furthermore, the present invention is aimed at providing a low-voltage power circuit breaker provided with a quick acting trip device, in which the response of the tripping device is linearly related to the arc development.

Moreover, the present invention is aimed at providing a low-voltage power circuit breaker provided with a quick acting trip device, in which the tripping action can be determined by each of the poles in an independent manner.

In addition, the present invention is aimed at providing a low-voltage power circuit breaker provided with a quick acting trip device, which is effective for both AC and DC currents.

Furthermore, the present invention is aimed at providing a low-voltage power circuit breaker provided with a quick acting trip device, in which the calibration operation are unnecessary or at least reduced.

Also, the present invention is aimed at providing a low-voltage power circuit breaker provided with a quick acting trip device, that is reliable and relatively easy to produce at competitive costs.

Thus, the present invention relates to a low-voltage circuit breaker which comprises at least one fixed contact, for each pole, which is electrically connected to a terminal for connection to an electric circuit and a corresponding moving contact which is associable/separable with respect to said fixed contact by means of a rotation of said moving contact. The low-voltage circuit breaker further comprises an arc chamber positioned in correspondence of said fixed contact and a rotating contact supporting shaft common to all poles, which is functionally connected to an actuation mechanism of the circuit breaker. In the circuit breaker of the invention, said actuation mechanism comprises a kinematic system operatively connected to an actuation lever for opening/closing operations and is provided with opening springs and a tripping shaft for releasing said kinematic system and allowing its movement from a closed to an open position. The circuit breaker of the present invention is characterized in that it comprises for each pole a quick acting trip device comprising a plunger inserted in a first channel connected to an arc chamber of the corresponding pole, said first channel being positioned proximate to said at least one fixed contact with its longitudinal axis perpendicular to the axis of said rotating contact supporting shaft, said plunger having a first operative surface subjected to the pressure of said arc chamber and a second operative surface, said quick acting trip device further comprising a trip lever having a first portion cooperating with said tripping shaft and a second portion cooperating with the second operative surface of said plunger.

As better explained in the following description, thanks to the particular structure of the low-voltage circuit breaker of the invention of the present invention, the above-mentioned problems can be avoided, or at least greatly reduced.

Indeed, the structure of the quick acting trip device included in the presently disclosed circuit breaker is such that it reacts directly and in a linear manner to the overpressure generated in the arc chamber by the development of an electrical arc.

Moreover, differently from the prior art systems based on overpressure, disclosed, e.g., in EP0455564, the intervention threshold of the quick acting trip device is not determined by the characteristics of a spring that can change during the operating life of the circuit breaker or as a consequence of the ambient (e.g., temperature) conditions, but is fixed during the design stage of the circuit breaker and remains constant.

In other words, the intervention threshold can be tailored during the designed stage of the circuit breaker by proper design and dimensioning of the channel in which the plunger is inserted, of the plunger itself, of the trip lever and of the mechanical coupling between the trip lever and the tripping shaft. The performances of the system then remain substantially constant throughout the operating life of the circuit breaker, since the quick acting trip device of the invention is substantially free from aging phenomena.

Also, since each pole of the circuit breaker of the present invention is provided with a corresponding quick acting trip device acting independently form the other, the system is more reliable and prompt to act, independently from the typology (AC or DC) of the electrical circuit in which it is placed.

In a preferred embodiment of the present invention, the trip lever and the trip shaft are rotatably mounted on a respective rotation axis, the rotation axis of said trip lever, of said trip shaft and of said rotating contact supporting shaft being parallel to each other and perpendicular to the longitudinal axis of said first channel. In this way a very compact and effective design of the circuit breaker can be achieved. Moreover, being the first channel positioned in the top portion of the arc chamber, close to the fixed contact, the plunger is immediately subject to the overpressure created by an electrical arc in the arc chamber, thereby ensuring a prompt response of the system in case of electrical arc development, minimizing the design complexity of the whole system and increasing its reliability In practice, as better explained in the following description, in a typical embodiment of the circuit breaker of the present invention, the plunger is slidingly movable in said first channel under the action of an overpressure created by an electrical arc within said arc chamber between a first resting position and a second operating position in which it urges against the second portion of said trip lever. As a consequence of the action of the plunger on it, the trip lever moves from a normal-operating position to a tripping position in which said trip lever, and in particular the second portion of said trip lever, acts on said tripping shaft determining the release of said kinematic system.

In order to restore the normal, not-operating position, of the plunger, said plunger is slidingly movable in said channel also between said second operating position and said first resting position. Conveniently, in a typical embodiment of the circuit breaker of the present invention, such reverse movement of the plunger takes place under the action of said trip lever when said kinematic system is moved from an open position to a closed position.

Preferably, the tripping shaft may be conveniently provided with an operating surface which mates the second portions of the trip lever, so as to be able to mutually interact with the trip lever during both the tripping and closing operations.

As previously explained, design and dimensioning of the plunger, of the first and second portions of the trip lever, and possibly of the operating surface of the tripping shaft can be made so as to have the desired intervention thresholds and times.

In order to ensure a proper venting of the arc chamber following the striking of an electrical arc in it, the low-voltage circuit breaker according to the present invention advantageously comprises a second, venting, channel which is separated from said first channel and put said arc chamber into communication with the outside of the circuit breaker.

In a typical embodiment of the present invention, the low-voltage circuit breaker, comprises, for each pole, a first and a second fixed contacts and respective corresponding first and second moving contacts which are associable/separable with respect to said fixed contacts by means of a rotation of said first and a second moving contacts. Then, a first and a second arc chambers are respectively positioned in correspondence of said first and second fixed contacts.

In such double-interruption embodiment, the quick acting trip device is conveniently associated with only one of the arc chambers. In practice, the plunger of the quick acting trip device is inserted in a first channel which is connected to only one of said first and second arc chambers. In order to keep the design of circuit breaker as simple as possible, the arc chamber operatively associated with the quick acting trip device is the one lying closer to the tripping shaft of the circuit breaker.

According to a particularly preferred embodiment of the low-voltage circuit breaker according to the present invention, said trip lever is pivotally secured on a fixed part of said circuit breaker. Actuation of the system takes therefore place by rotation of the trip lever around the pivot point on the fixed part of the circuit breaker.

Preferably, said trip lever has a central body which is pivotally secured on a fixed part of said circuit breaker. The first portion of said trip lever can advantageously be a shaped surface, e.g. a cam surface, of said central body, while the second portion of said trip lever can advantageously be an arm protruding from said central body.

In such a case, the action of the plunger—pushed by the overpressure created by an electrical arc into the arc chamber—on the arm protruding from said central body brings about a rotation of said trip lever in a first direction so that the shaped surface of said central body urges on said tripping shaft, thereby determining the release of the kinematic system of the circuit breaker. To this purpose, the tripping shaft may be conveniently provided with an operating surface mating the shaped surface of the central body of the trip lever.

Then, in order to restore the original conditions of the low-voltage circuit breaker, said trip lever rotates in a second direction opposite to said first direction under the action of said tripping shaft on the shaped surface of said central body. As a consequence of such rotation, the arm protruding from said central body pushes on the second operative surface of said plunger and moves it from said second operating position back to said first resting position.

In a typical embodiment of the low-voltage circuit breaker of the present invention, the plunger of the quick acting trip device has a substantially cylindrical body which is inserted in a substantially gas-tight manner into said first channel. However, shape and dimensioning of the plunger can be different according to the needs and the design of the circuit breaker, Further features and advantages of the present invention will be more clear from the description of preferred but not exclusive embodiments of the low-voltage power circuit breaker of the present invention, shown by way of examples in the accompanying drawings, wherein:

Figure 1:
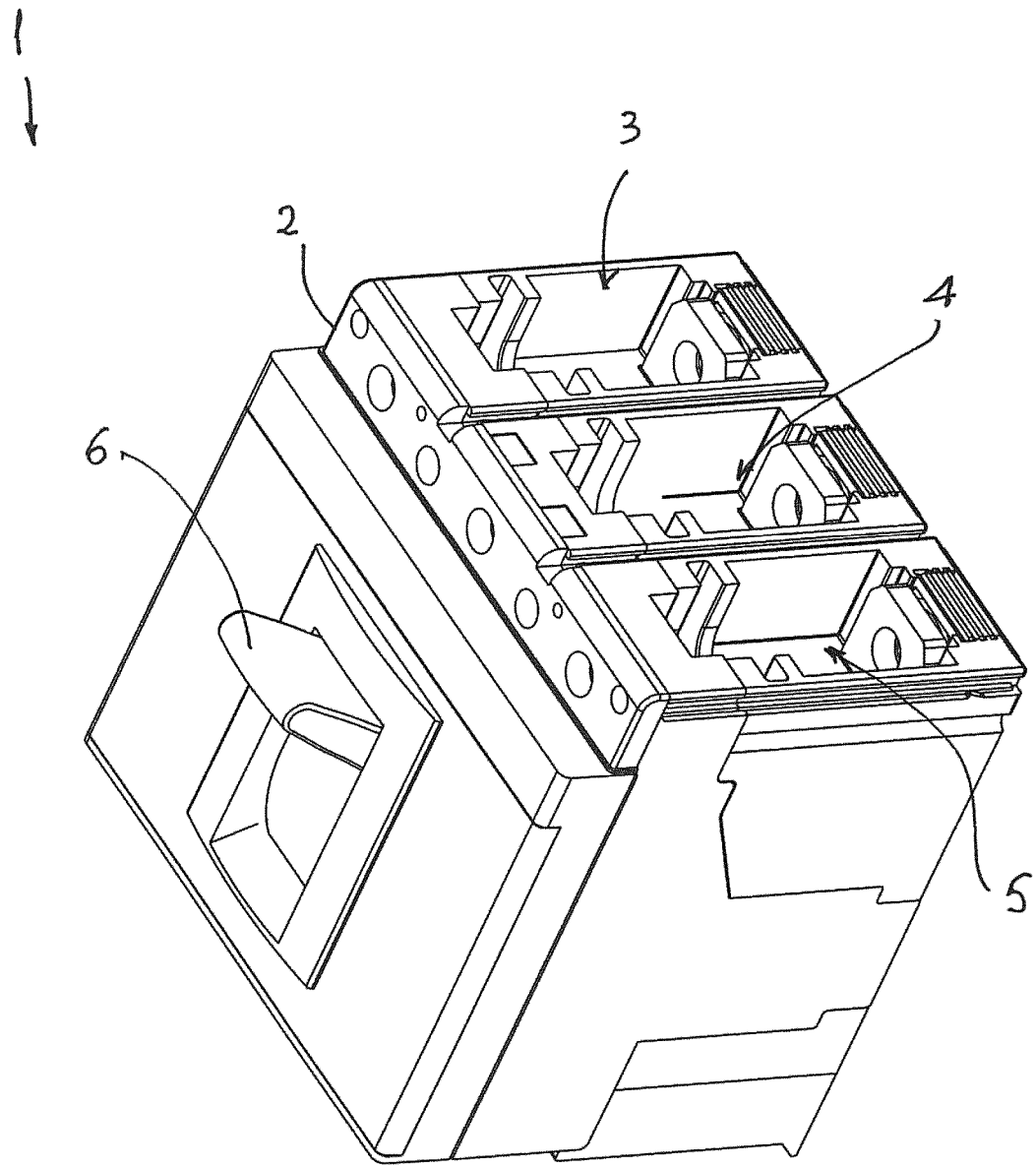
FIG. 1 is a perspective view of a low voltage power circuit breaker, according to the invention.

With reference to the attached figures, the low voltage power circuit breaker of the present invention, designated by the reference numeral 1, in its more general definition, comprises a casing 2 housing a number of poles 3, 4, 5. On the front side of the circuit breaker 1, there is provided an actuation lever 6 for carrying out the opening and closing operations of the circuit breaker 1.

Each pole 3, 4, 5 of the circuit breaker 1 comprises at least one fixed contact which is electrically connected to a terminal for connection to an electric circuit and a corresponding moving contact which is associable/separable with respect to said fixed contact by means of a rotation of said moving contact.

Each pole 3, 4, 5 further comprises an arc chamber which is positioned in correspondence of said fixed contact.

In the embodiment shown in FIGS. 2-5, the low-voltage circuit breaker is a double-interruption circuit breaker and comprises, for each pole 3, 4, 5, a first 20 and a second 30 fixed contacts and respective corresponding first 21 and second 31 moving contacts which can be connected to and separated form said fixed contacts 20 and 30 by means of a rotation of said first 21 and second 31 moving contacts.

Correspondingly, the circuit breaker 1 further comprises a first 40 and a second 41 arc chambers which are respectively positioned in correspondence of said first 20 and second 30 fixed contacts.

The low voltage power circuit breaker 1 of the present invention further comprises a rotating contact supporting shaft 50 which is common to all poles 3, 4, 5 and which supports and imparts motions to the moving contacts. The rotating contact supporting shaft 50 is functionally connected to an actuation mechanism of the circuit breaker 1.

According to known embodiments of a low-voltage circuit breaker, said actuation mechanism typically comprises a kinematic system which is operatively connected to the actuation lever 6 for opening/closing operations and provided with opening springs and a tripping shaft 60 for unlatching said kinematic system and allowing its automatic movement from a closed to an open position. The functioning of the actuation mechanism and of the various element thereof (e.g., its kinematic system with opening springs and a tripping shaft) are well known in the art and will not be described in further details.

An essential feature of the low voltage power circuit breaker 1 of the present invention is given by the presence—in each pole 3, 4, 5 thereof—of a quick acting trip device 100 having previously undisclosed characteristics and performances.

In the following description, the quick acting trip device 100 will be described with reference to the pole 3 of the circuit breaker, but the set-up for poles 4, 5 of the circuit breaker 1 is the same. Also, the circuit-breaker 1 of FIG. 1 is a three-pole circuit breaker, but the present invention is also applicable to circuit breakers having a different number of poles.

With reference to FIGS. 2-5, the quick acting trip device 100 of the circuit breaker 1 of the present invention comprises a plunger 101 which is inserted in a first channel 102 connected to an arc chamber 40 of the corresponding pole 3.

As shown in the attached figures, the first channel 102 is positioned proximate to a fixed contact 20 and its longitudinal axis is perpendicular to the axis of said rotating contact supporting shaft 50. In this way, a prompt response of the plunger 101 to the overpressure created by an electrical arc is ensured.

The plunger 102 has a first operative surface 103 which faces toward the arc chamber 40 and is subjected to the pressure of said arc chamber 40, and a second operative surface (104), opposite to said first operative surface 103.

The quick acting trip device 100 further comprises a trip lever 110 which has a first portion 111 cooperating with said tripping shaft 60 and a second portion 112 cooperating with the second operative surface 104 of said plunger 101, according to operating principles better described hereinafter.

In practice, in the low-voltage circuit breaker 1 of the present invention, the plunger 101 is slidingly movable inside said first channel 102 under the action of an overpressure created within said arc chamber 40 as a consequence of an electrical arc. The movement of the plunger 101 takes place between a first resting position and a second operating position in which it is pushed in the first channel 101 and urges against the second portion 112 of said trip lever 110.

In turn, under the action of the plunger 101, the trip levers 110 moves from a non-operating position to a tripping position in which said trip lever 110 acts on the tripping shaft 60 of the kinematic system of the circuit breaker determining the unlatching of said kinematic system and its automatic passage from a closed position to an open position.

According to a very effective design solution, the trip lever 110 and the trip shaft 60 are rotatably mounted on a respective rotation axis. In particular, the rotation axis of said trip lever 110, of said trip shaft 60 and of said rotating contact supporting shaft 50 are parallel to each other and perpendicular to the longitudinal axis of said first channel 102, thereby achieving a very compact and simple design structure that allows minimizing mechanical stresses on the kinematic chain: plunger 101-trip lever 110-trip shaft 60 and ensuring a fast response thereof.

In practice, according to this solution the plunger 101 moves inside the first channel 102 in a direction which is perpendicular to the rotation axis of said trip lever 110, of said trip shaft 60 and of said rotating contact supporting shaft 50. Being the first channel 102 positioned on the top of the arc chamber, close to the fixed contact, it is also close to the trip lever 110, thereby minimizing the design complexity of the whole system and increasing its reliability.

In order to restore the normal operating conditions, the plunger 101 is also slidingly movable in said first channel 102 under the action of said trip lever 110 between said second operating position and said first resting position when said kinematic system is moved from an open position to a closed position.

In practice, when an electrical arc occurs and an overpressure is created inside the arc chamber 40, the plunger 101 is pushed against the trip lever 110 which therefore acts on the on the tripping shaft 60 determining the unlatching of the kinematic system of the circuit breaker 1.

Conversely, when the circuit breaker 1 is closed by acting on the actuation lever 6, the kinematic system is moved from the open position to the closed position and so is the tripping shaft 60 and the trip lever 110. During such movement, the trip lever 110 acts on the plunger 101 bringing it back to its first resting position.

As shown in the attached figures, the arc chamber 40 advantageously comprises a second, venting, channel 45 which is separated from said first channel 102. In practice, the second, venting, channel 45 is the main venting opening of the arc chamber 40 toward the exterior of the circuit breaker 1 and is conveniently kept separated from the first channel 102 which is just an operating channel for the quick acting trip device 100. Shape and dimensioning of the second, venting, channel 45 can be designed according to the needs. Also, more venting channels are possible depending on the needs.

As previously said, in the embodiment shown in the attached FIGS. 2-5, the low-voltage circuit breaker 1 comprises, for each pole 3, 4, 5, a first 20 and a second 30 fixed contacts and respective corresponding first 21 and second 31 moving contacts which can be coupled to and uncoupled form said fixed contacts 20, 30 by means of a rotation of said first 21 and second 31 moving contacts.

A first 40 and a second 41 arc chambers are also present and are respectively positioned in correspondence of said first 20 and second 30 fixed contacts. The quick acting trip device 100 is conveniently associated with only one of the arc chambers, in particular with the arc chamber 40, which is the one closer to the tripping shaft 60. Therefore, the plunger 101 of the quick acting trip device 100 is inserted in the first channel 102, which is connected to said first arc chamber 40.

From a mechanical standpoint, the trip lever 110 in the embodiment shown is pivotally secured on a fixed part of said circuit breaker 1.

In particular, the trip lever 110 has a central body 113, which is pivotally secured on a fixed part of the circuit breaker 1. The first portion 111 of said trip lever 110 is a shaped surface, in the embodiment shown a cam-shaped surface, of the central body 113, while the second portion 112 of the trip lever 110 is an arm protruding from said central body 113.

The functioning of the circuit breaker 1, and in particular of the quick acting trip device 100 in a typical embodiment of the invention, will be now described with reference to the attached FIGS. 2-5.

Figure 2:
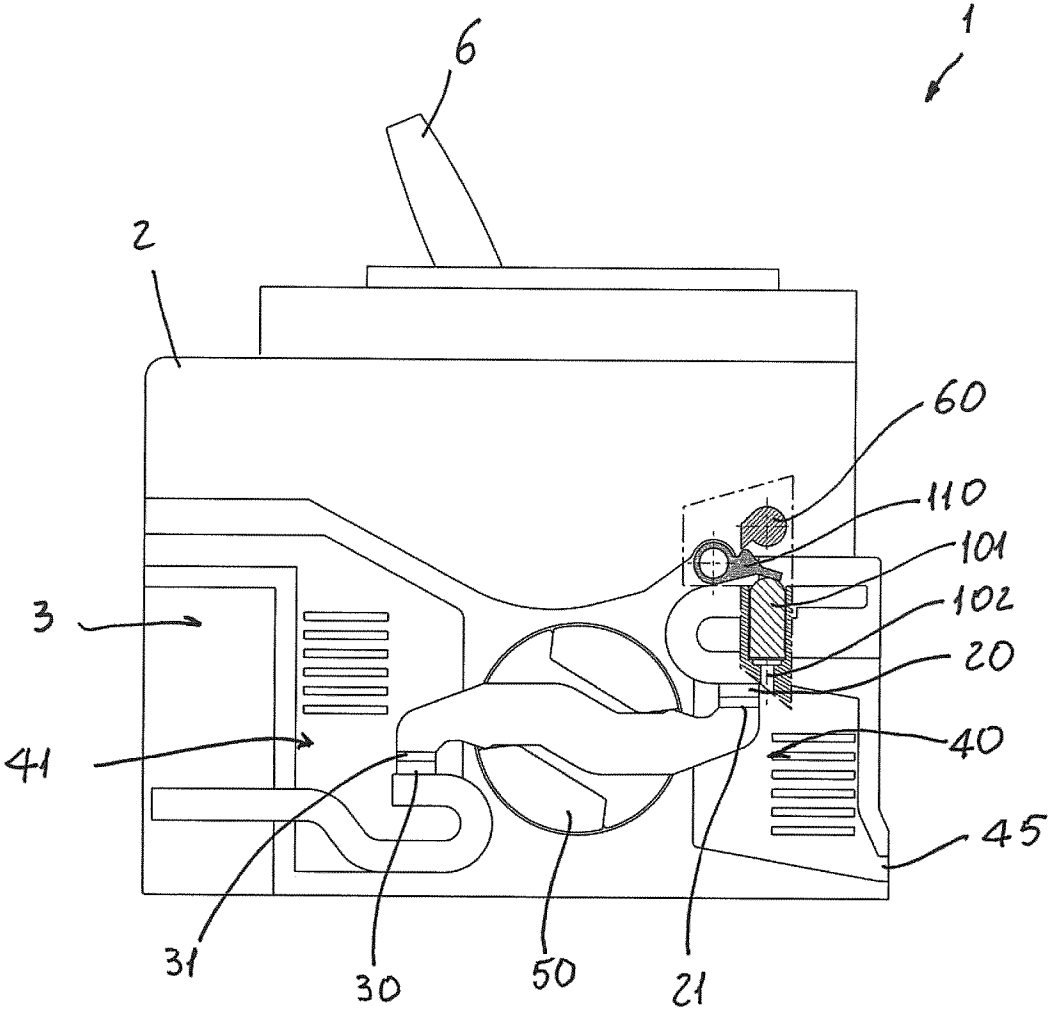
FIG. 2 is a section view of a pole of a low voltage power circuit breaker, according to the invention, in a first operative condition.

With reference to FIG. 2, in the closed conditions of the circuit breaker 1 the moving contacts 21 and 31 are coupled to the corresponding fixed contacts 20, 30 and current flows into the circuit. For each pair of contacts the current flows in the movable contact in an opposite direction with respect to fixed contact.

In case of a short circuit the current increase abruptly and the repulsion forces generated by the current flowing in two opposite directions in the fixed and moving contacts brings about separation of the moving contact 21 and 31 from the corresponding fixed contact 20 and 30. Under such conditions, an arc is generated inside the arc chambers 40 and 41 with a corresponding sharp increase of pressure inside them.

Figure 3:
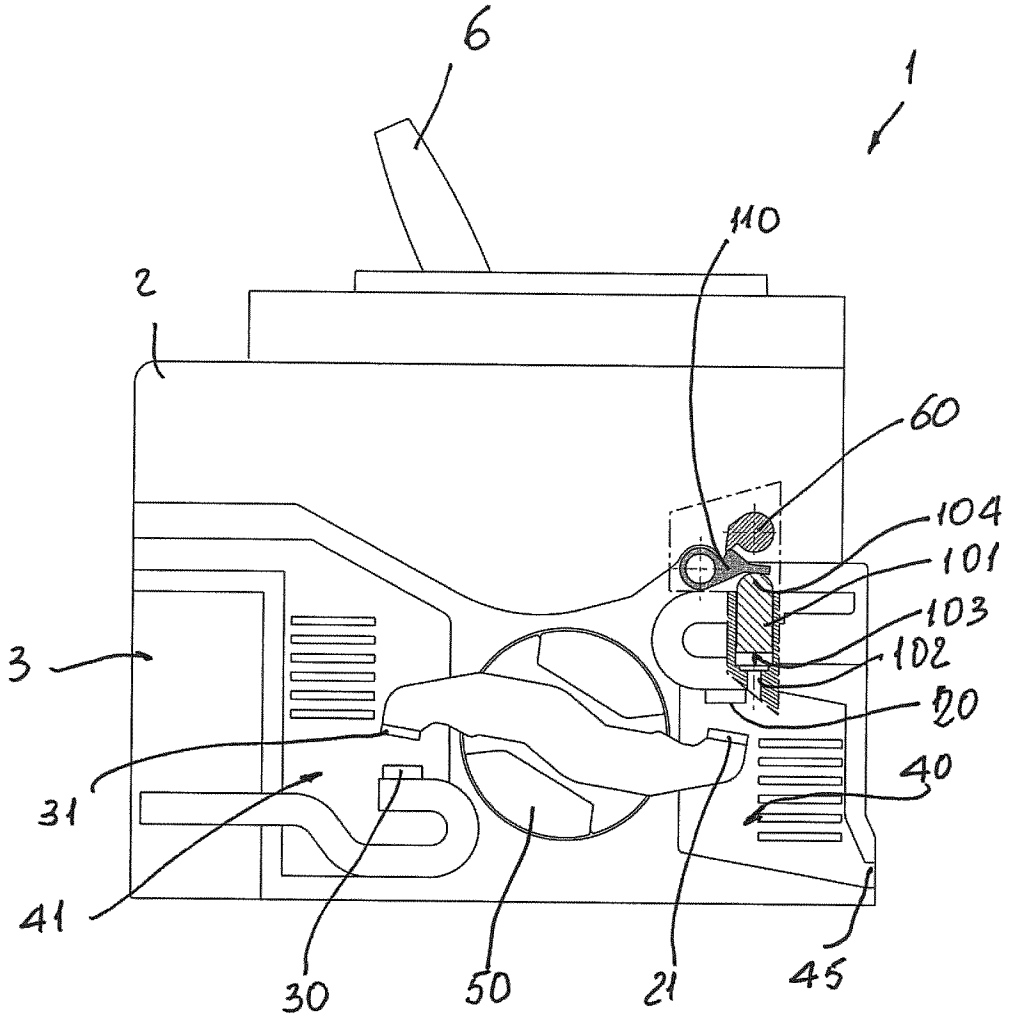
FIG. 3 is a section view of a pole of a low voltage power circuit breaker, according to the invention, in a second operative condition.
Figure 4:
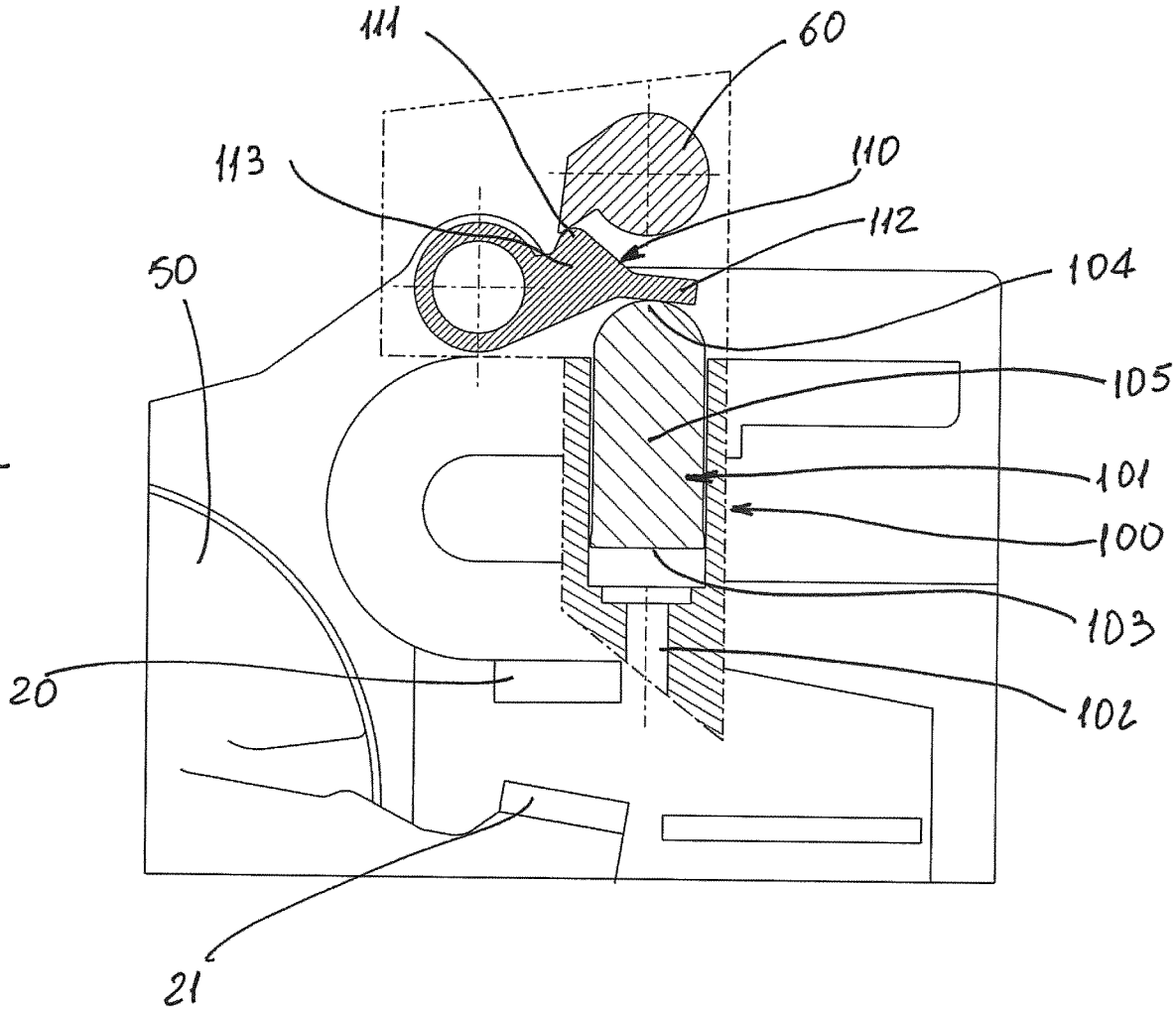
FIG. 4 is an enlarged view of a quick acting trip device of a low voltage power circuit breaker, according to the invention, in the second operative condition shown in FIG. 3.

In particular, with reference to FIGS. 3 and 4, the overpressure inside the arc chamber 40 starts the tripping action of the quick acting tripping device 100 positioned in correspondence of said arc chamber 40.

In practice, the plunger 101 is pushed inside the channel 102 by the action exerted by the overpressure on the first operative surface 103 thereof. Then, as a consequence of the action of said plunger 101 on the arm 112 protruding from the central body 113 of the trip lever 110, said trip lever 110 rotates in a first direction (i.e., counterclockwise in the embodiment shown). During such rotation, the cam-shaped surface 111 of the central body 113 of the trip lever 110 urges on the tripping shaft 60, determining its clockwise rotation and the unlatching of the kinematic system of the circuit breaker.

Figure 5:
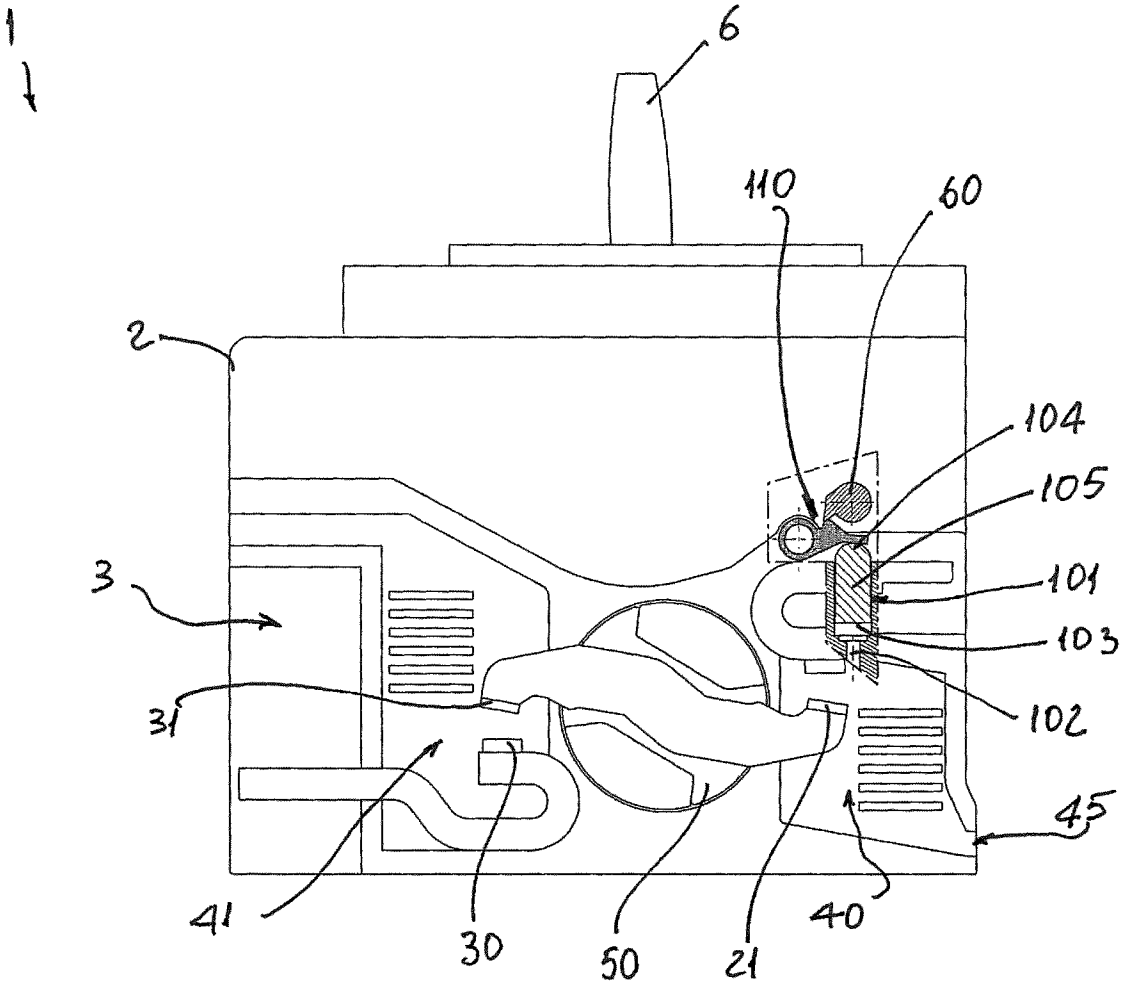
FIG. 5 is a section view of a pole of a low voltage power circuit breaker, according to the invention, in a third operative condition.

FIG. 5 shows the position of the system when the tripped action of the circuit breaker 1 is completed.

When the low-voltage circuit breaker 1 is closed, e.g. by acting on actuation lever 6, the kinematic system is operated so as to rotate the rotating contact supporting shaft 50 counterclockwise and put the moving contacts 21 and 31 in contact with the corresponding fixed contacts 20 and 30. At the same time, the tripping shaft is rotated counterclockwise to latch the mechanism.

During such rotation, the tripping shaft 60 urges on the cam-shaped surface 111 of the central body 113 of the trip lever 110. Under the action of the tripping shaft 60 on the cam-shaped surface 111 of the central body 113, said trip lever 110 rotates in a second direction (i.e., clockwise in the embodiment shown) which is opposite to said first direction. During such rotation, the arm 112 protruding from the central body 113 of the trip lever 110 pushes on the second operative surface 104 of said plunger 101 and moving it back from said second operating position to said first resting position (i.e. the situation of FIG. 2).

It is clear from the above description that the low voltage power circuit breaker of the present invention, fully achieve the intended aims and solved the above-highlighted problems of the existing electrical cabinets.

In practice, as previously explained, in the low voltage power circuit breaker of the present invention, the operation quick acting trip device is directly linked to an arc formation in the chamber and linearly dependent upon it. Moreover, the device is substantially free from aging phenomena, much more reliable than the existing systems and makes complicated calibration processes unnecessary.

Several variations can be made to the low voltage power circuit breaker thus conceived, all falling within the scope of the attached claims. In practice, the materials used and the contingent dimensions and shapes can be any, according to requirements and to the state of the art.

The invention claimed is:

1. A low-voltage circuit breaker, comprising:

at least one fixed contact, for each pole, which is electrically connected to a terminal for connection to an electric circuit, and a corresponding moving contact which is associable/separable with respect to said fixed contact by means of a rotation of said moving contact;

an arc chamber positioned in correspondence of said fixed contact;

a rotating contact supporting shaft common to all poles, which is functionally connected to an actuation mechanism of the low-voltage circuit breaker, said actuation mechanism comprising a kinematic system operatively connected to an actuation lever for opening/closing operations and provided with opening springs and a tripping shaft for releasing said kinematic system and allowing movement of said kinematic system from a closed position to an open position, wherein for each pole, a quick acting trip device comprises:

a plunger inserted in a first channel connected to the arc chamber of a corresponding pole, said first channel having a longitudinal axis perpendicular to an axis of rotation of said rotating contact supporting shaft, said plunger having a first operative surface subjected to a pressure of said arc chamber, said plunger having a second operative surface subjected to a pressure less than the pressure of said arc chamber, wherein said plunger and said first channel extend cylindrically from the first operative surface of said plunger to the second operative surface of said plunger; and a trip lever having a first portion cooperating with said tripping shaft and a second portion cooperating with the second operative surface of said plunger, wherein, under an action of an overpressure within said arc chamber, said plunger is slidingly movable in said first channel from a first resting position to a second operating position, wherein movement of said plunger to the second operating position urges said plunger against the second portion of said trip lever, thereby causing said trip lever to move from a normal-operating position to a tripping position in which said trip lever acts on said tripping shaft, in turn causing a release of said kinematic system, and wherein, under an action of said trip lever, said plunger is slidingly movable in said first channel from said second operating position to said first resting position when said kinematic system is moved from the open position to the closed position.

2. The low-voltage circuit breaker, according to claim 1, wherein said arc chamber comprises a second, venting, channel separated from said first channel.

3. The low-voltage circuit breaker, according to claim 2, wherein for each pole, a first and a second fixed contacts and respective corresponding first and second moving contacts which are associable/separable with respect to said first and second fixed contacts by means of a rotation of said first and second moving contacts, a first and a second arc chambers being respectively positioned in correspondence of said first and second fixed contacts, said plunger being inserted in said first channel which is connected to one of said first and second arc chambers.

4. The low-voltage circuit breaker, according claim 3, wherein said trip lever is pivotally secured on a fixed part of said low-voltage circuit breaker.

5. The low-voltage circuit breaker, according to claim 4, wherein said trip lever has a central body pivotally secured on the fixed part of said low-voltage circuit breaker, the first portion of said trip lever being a shaped surface of said central body, the second portion of said trip lever being an arm protruding from said central body.

6. The low-voltage circuit breaker, according to claim 5, wherein under the action of said plunger on the arm protruding from said central body, said trip lever rotates in a first direction and the shaped surface of said central body urges on said tripping shaft.

7. The low-voltage circuit breaker, according to claim 6, wherein under an action of said tripping shaft on the shaped surface of said central body, said trip lever rotates in a second direction opposite to said first direction, the arm protruding from said central body pushing on the second operative surface of said plunger and moving said plunger from said second operating position to said first resting position.

8. The low-voltage circuit breaker, according claim 7, wherein said plunger has a cylindrical body.

9. The low-voltage circuit breaker, according to claim 8, wherein said trip lever and said tripping shaft are rotatably mounted on a respective rotation axis, a rotation axis of said trip lever, of said tripping shaft and of said rotating contact supporting shaft being parallel to each other and perpendicular to the longitudinal axis of said first channel.

10. The low-voltage circuit breaker, according to claim 1, wherein for each pole, a first and a second fixed contacts and respective corresponding first and second moving contacts which are associable/separable with respect to said first and second fixed contacts by means of a rotation of said first and second moving contacts, a first and a second arc chambers being respectively positioned in correspondence of said first and second fixed contacts, said plunger being inserted in said first channel which is connected to one of said first and second arc chambers.

11. The low-voltage circuit breaker, according to claim 1, wherein said trip lever is pivotally secured on a fixed part of said low-voltage circuit breaker.

12. The low-voltage circuit breaker, according to claim 1, wherein said trip lever has a central body pivotally secured on a fixed part of said low-voltage circuit breaker, the first portion of said trip lever being a shaped surface of said central body, the second portion of said trip lever being an arm protruding from said central body.

13. The low-voltage circuit breaker, according to claim 12, wherein under an action of said plunger on the arm protruding from said central body, said trip lever rotates in a first direction and the shaped surface of said central body urges on said tripping shaft.

14. The low-voltage circuit breaker, according to claim 13, wherein under an action of said tripping shaft on the shaped surface of said central body, said trip lever rotates in a second direction opposite to said first direction, the arm protruding from said central body pushing on the second operative surface of said plunger and moving said plunger from said second operating position to said first resting position.

15. The low-voltage circuit breaker, according to claim 1, wherein said trip lever and said tripping shaft are rotatably mounted on a respective rotation axis, a rotation axis of said trip lever, of said trip shaft and of said rotating contact supporting shaft being parallel to each other and perpendicular to the longitudinal axis of said first channel.

* * * * *